US005881742A

United States Patent [19]

Hunsberger

[11] Patent Number: 5,881,742

[45] Date of Patent: Mar. 16, 1999

[54] MULTI-PURPOSE COSMETIC APPLICATOR

[76] Inventor: Glenn E Hunsberger, 24 Spruce La., New Hyde Park, N.Y. 11040

[21] Appl. No.: 107,556

[22] Filed: Jun. 29, 1998

[51] Int. Cl.[6] ..... A45D 33/28; A45D 33/24; A45D 40/24

[52] U.S. Cl. ..... 132/297; 132/294; 132/317

[58] Field of Search ..... 132/297, 294, 132/317, 318, 313, 314; 401/18, 23, 34, 57

[56] References Cited

U.S. PATENT DOCUMENTS

| | | | |
|---|---|---|---|
| 3,171,416 | 3/1965 | Pimentel | 132/79 |
| 3,592,202 | 7/1971 | Jones | 132/314 |
| 5,056,179 | 10/1991 | Capponi | 15/105 |
| 5,373,940 | 12/1994 | Hillelson | 206/385 |
| 5,620,270 | 4/1997 | Gueret | 401/126 |
| 5,655,554 | 8/1997 | Goldberg | 132/314 |

*Primary Examiner*—John J. Wilson
*Assistant Examiner*—Trang Doan
*Attorney, Agent, or Firm*—Michael I. Kroll

[57] ABSTRACT

A multi-purpose cosmetic applicator for aiding a person in applying numerous types of cosmetics thereby eliminating the need to carry individual applicators. The applicator includes a plurality of hollow sections, each having a circumference and including first and second ends connected by a midsection. A plurality of applicator units, each having a circumference substantially equal to the circumference of the hollow sections, include a central section, a first applicator device extending from a first side of the central section and a second applicator device extending from a second side of the central section. A releasable pressure seal is formed between one end of each hollow section and a respective one of the applicator units such that one of the applicator devices extends into the midsection of the respective hollow section and the other applicator device extends from one of the first and second ends. Each of the hollow section/applicator device combinations form a releasable pressure seal with adjacent section/applicator device combinations to form the multi-purpose cosmetic applicator. A lip stick holder may be connected to an end one of the hollow section/applicator device combinations and a make-up brush may be connected to an opposite end of an end one of the hollow section/applicator device combinations. Both the first and second ends may include teeth extending therearound whereby the teeth on the first end of a hollow section/applicator device combination mate with the teeth on the second end of an adjacent hollow section/applicator device combination.

19 Claims, 8 Drawing Sheets

MULTI-PURPOSE COSMETIC APPLICATOR

BACKGROUND OF THE INVENTION

1. Field of the Invention

The present invention relates generally to cosmetic applicators and, more specifically, to a cosmetic applicator including numerous application devices contained within a single multi-purpose applicator unit allowing the application of numerous different types of make-up and cosmetics while eliminating the need for a plurality of different individual applicator utensils.

2. Description of the Prior Art

Numerous types of cosmetic applicators such as pencil type brushes, sponges, eyeliners, blemish concealers, lipsticks, etc. and devices for retaining such applicators have been provided in the prior art. For example, U.S. patents numbered 3,592,202; 5,056,179; 5,620,270 and 5,655,554 all are illustrative of such prior art. While these units may be suitable for the particular purpose to which they address, they would not be as suitable for the purposes of the present invention as heretofore described.

This invention is a fingernail polish kit or toiletry article having a rigid, central, handle-forming body or sleeve of appropriate length to contain within the same lint cotton, gauze, or other appropriate preferably absorbent substance used in manicuring. In each end of the sleeve is frictionally and removably telescoped a tube container either having a readily distortable wall portion or the entire tube flexible with a stopper or plug at its open end, one of the containers being adapted to receive fingernail polish remover and the other, fingernail polish. Each stopper is provided with an axial channel or passage in the outer end of which is a removable and replaceable brush so that when the container is squeezed it will expel a drop of the liquid for application by the brush to a fingernail, a removable and replaceable protective cap or cover being provided for each brush with one cover of a different detectable characteristic from the other to enable the device to be used regardless of whether in the light or not. Also a holder is provided in the form of a base which may be a suction cup and an upwardly opening yoke for receiving the body of the device so that when on a flat surface it will not roll, and alternately the device may be attached to a surface either horizontal or otherwise.

A cosmetic applicator embodies two cosmetic applicator elements in a single barrel housing. One applicator element is slidably extendible from retracted position in the housing to extended use position wherein it is extended axially a distance from an opening at one end of the housing. The other applicator element rotatably is axially extended from retracted position in the housing to use position. The operating means by which each element is extended are located in the housing in such manner that the operating means associated with the said other element lies nested in the operating means associated with the first applicator element when that element is retracted. Thus, the length of the housing can be shortened and still accommodate both operating means since they occupy a common length extend in the housing. One applicator element can be a lip brush and the other an eyeliner.

A device for storage and application of a makeup product includes a container and two applicators each including a rod provided at one end with an application element for the makeup product and attached at its other end to a gripping element in the form of a cap. The rod of a first applicator is hollow over at least a portion of its length and defines an axial hollow in which the application element and the rod of second applicator are accommodated. The wall of the rod of the first applicator comprises at least one slot permitting communication between its axial hollow and the internal volume of the container. The gripping element, in the form of a cap, of the second applicator is connected in a removable fashion with the gripping element, in the form of a cap, of the first applicator.

A selectively detachable combination cosmetic applicator device is provided. The cosmetic applicator device includes a nail polish applicator container that is releasably attached to a nail polish remover container. The device also incorporates an on-board chamber for storing absorbent materials of the like. The chamber is prohibited from contact with either the nail polish or the nail polish remover. The containers of the device can readily be refilled and can be used at the same time when they are detached.

SUMMARY OF THE PRESENT INVENTION

The present invention relates generally to cosmetic applicators and, more specifically, to a cosmetic applicator including numerous application devices contained within a single multi-purpose applicator unit allowing the application of numerous different types of make-up and cosmetics while eliminating the need for a plurality of different individual applicator utensils.

A primary object of the present invention is to provide a multi-purpose cosmetic applicator that will overcome the shortcomings of prior art devices.

Another object of the present invention is to provide a multi-purpose cosmetic applicator which is able to retain a plurality of cosmetic applicators within a single self-contained unit.

A further object of the present invention is to provide a multi-purpose cosmetic applicator which allows a user to apply numerous types of make-up and cosmetics such as eyeliner, blush, blemish consealers, lipstick, etc. using a single device.

A still further object of the present invention is to provide a multi-purpose cosmetic applicator including any combination of an eyebrow brush, eyeliner, sponge, comb, lipstick holder and make-up brush.

An even further object of the present invention is to provide a multi-purpose cosmetic applicator having a make-up brush extending therefrom including three individually retractable sections thereby allowing the user to adjust the brush to a desired width.

A further object of the present invention is to provide a multi-purpose cosmetic applicator wherein the housing is divided into a plurality of releasably connected sections, the individual applicators each being contained within a respective one of the plurality of sections of the housing.

Another object of the present invention is to provide a multi-purpose cosmetic applicator wherein releasing a desired section from its connection to an adjacent section of the housing exposes the applicator contained therein.

Another object of the present invention is to provide a multi-purpose cosmetic applicator that is simple and easy to use.

A still further object of the present invention is to provide a multi-purpose cosmetic applicator that is economical in cost to manufacture.

Additional objects of the present invention will appear as the description proceeds.

A multi-purpose cosmetic applicator for aiding a person in applying numerous types of cosmetics thereby eliminating the need to carry individual applicators is disclosed by the present invention. The applicator includes a plurality of hollow sections, each having a circumference and including first and second ends connected by a midsection. A plurality of applicator units, each having a circumference substantially equal to the circumference of the hollow sections, include a central section, a first applicator device extending from a first side of the central section and a second applicator device extending from a second side of the central section. A releasable pressure seal is formed between one end of each hollow section and a respective one of the applicator units such that one of the applicator devices extends into the midsection of the respective hollow section and the other applicator device extends from one of the first and second ends thereby allowing the applicator device to be removed from the hollow section. Each of the hollow section/applicator device combinations form a releasable pressure seal with adjacent section/applicator device combinations to form the multi-purpose cosmetic applicator allowing a desired applicator device to be exposed for use. A lip stick holder may be connected to an end one of the hollow section/applicator device combinations and a make-up brush may be connected to an opposite end of an end one of the hollow section/applicator device combinations. Both the first and second ends may include teeth extending therearound whereby the teeth on the first end of a hollow section/applicator device combination mate with the teeth on the second end of an adjacent hollow section/applicator device combination.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

Figure 2:
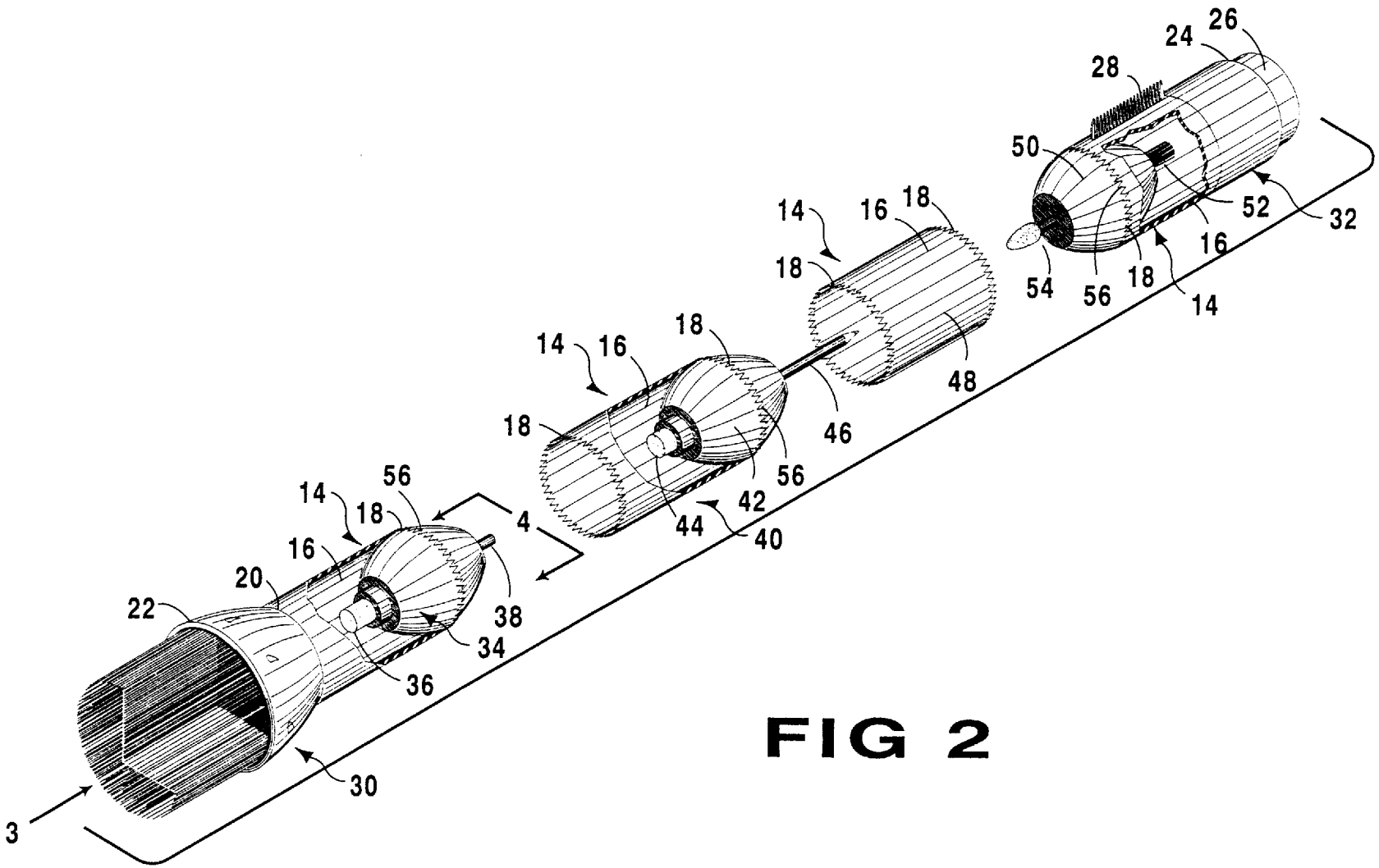
FIG. 2 is an exploded top perspective view of the multi-purpose cosmetic applicator of the present invention.
Figure 3:
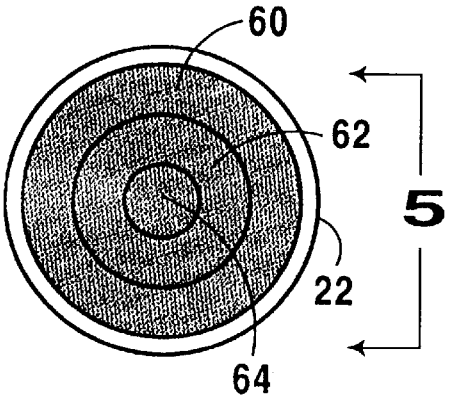
FIG. 3 is a top view of the multi-purpose cosmetic applicator of the present invention taken in the direction of the arrow 3—3 with three sections of the brush exposed.
Figure 3A:
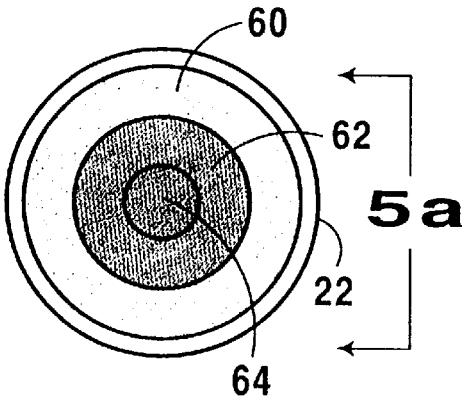
Figure 3B:
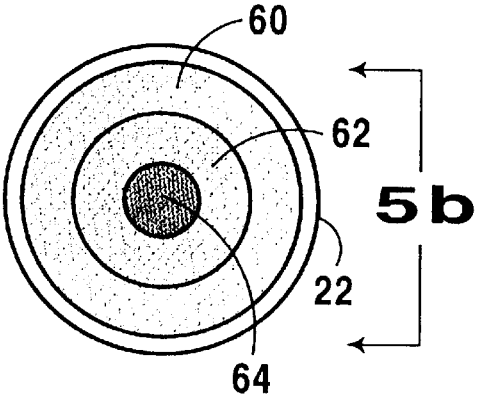
Figure 4:
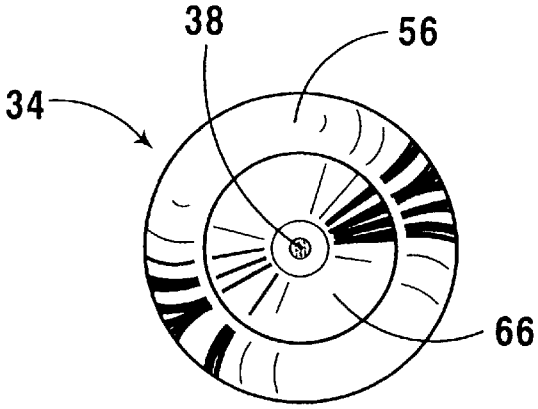
Figure 5:
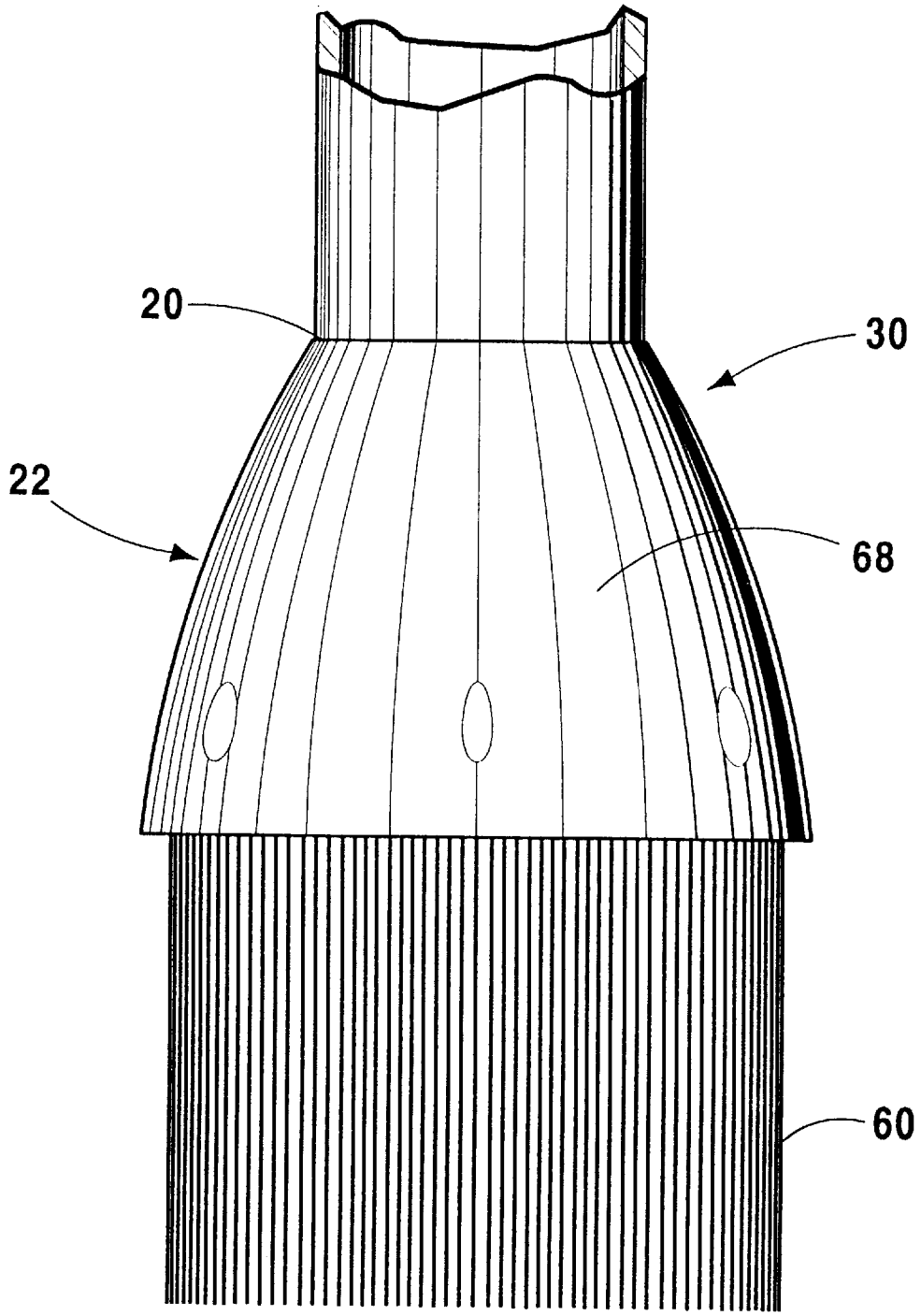
Figure 5A:
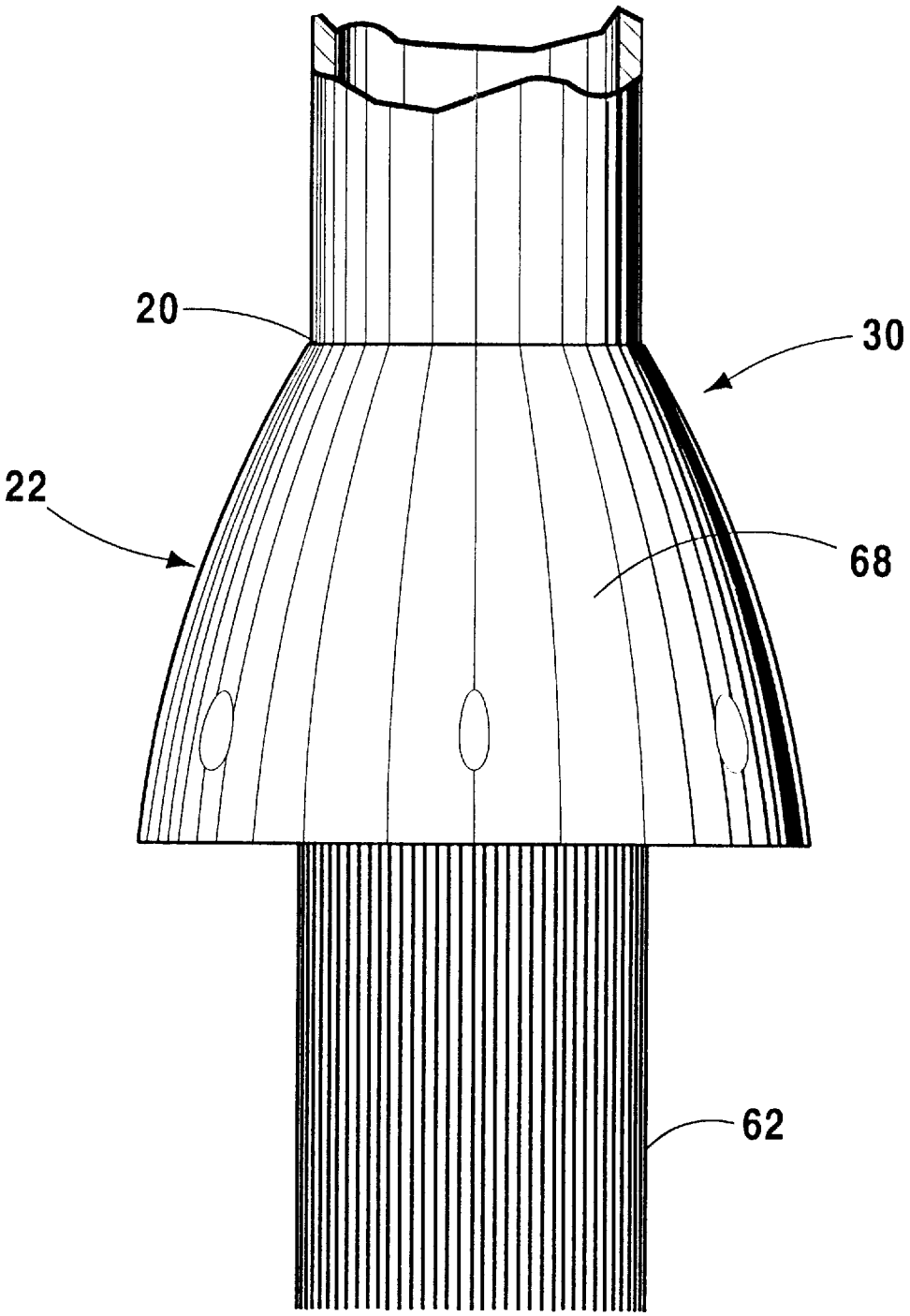

FIG. 3*a* is a top view of the multi-purpose cosmetic applicator of the present invention taken in the direction of the arrow 3—3 with two sections of the brush exposed and one section retracted;

FIG. 3*b* is a top view of the multi-purpose cosmetic applicator of the present invention taken in the direction of the arrow 3—3 with one section of the brush exposed and two sections retracted;

FIG. 4 is a top view of the multi-purpose cosmetic applicator of the present invention taken in the direction of the arrow 4—4 of FIG. 2;

FIG. 5 is a side view of a portion of the multi-purpose cosmetic applicator of the present invention taken in the direction of the arrow labeled 5 of FIG. 3;

FIG. 5*a* is a side view of a portion of the multi-purpose cosmetic applicator of the present invention taken in the direction of the arrow labeled 5*a* of FIG. 3*a;*

Figure 5B:
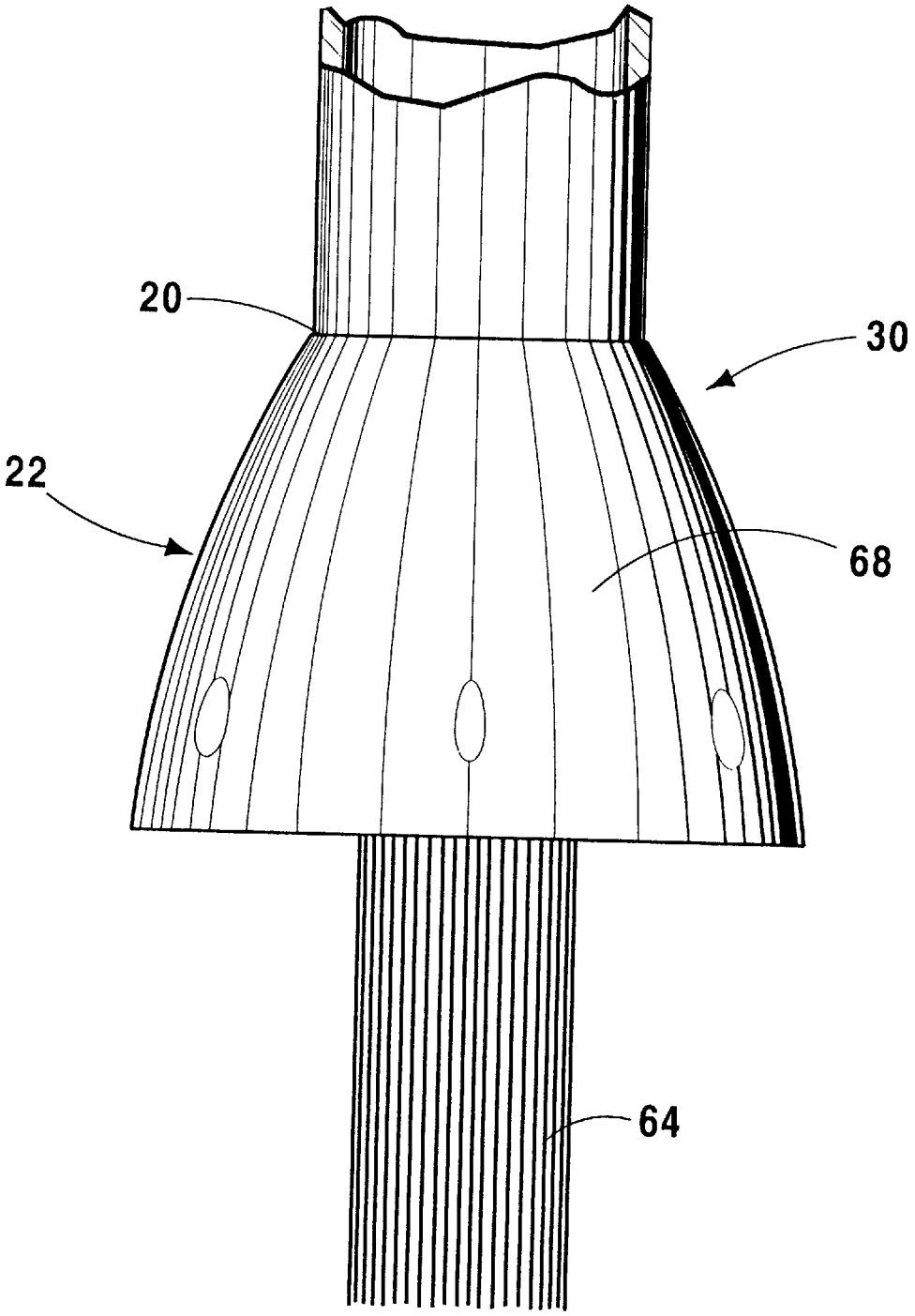

FIG. 5*b* is a side view of a portion of the multi-purpose cosmetic applicator of the present invention taken in the direction of the arrow labeled 5*b* of FIG. 3*b;*

Figure 6:
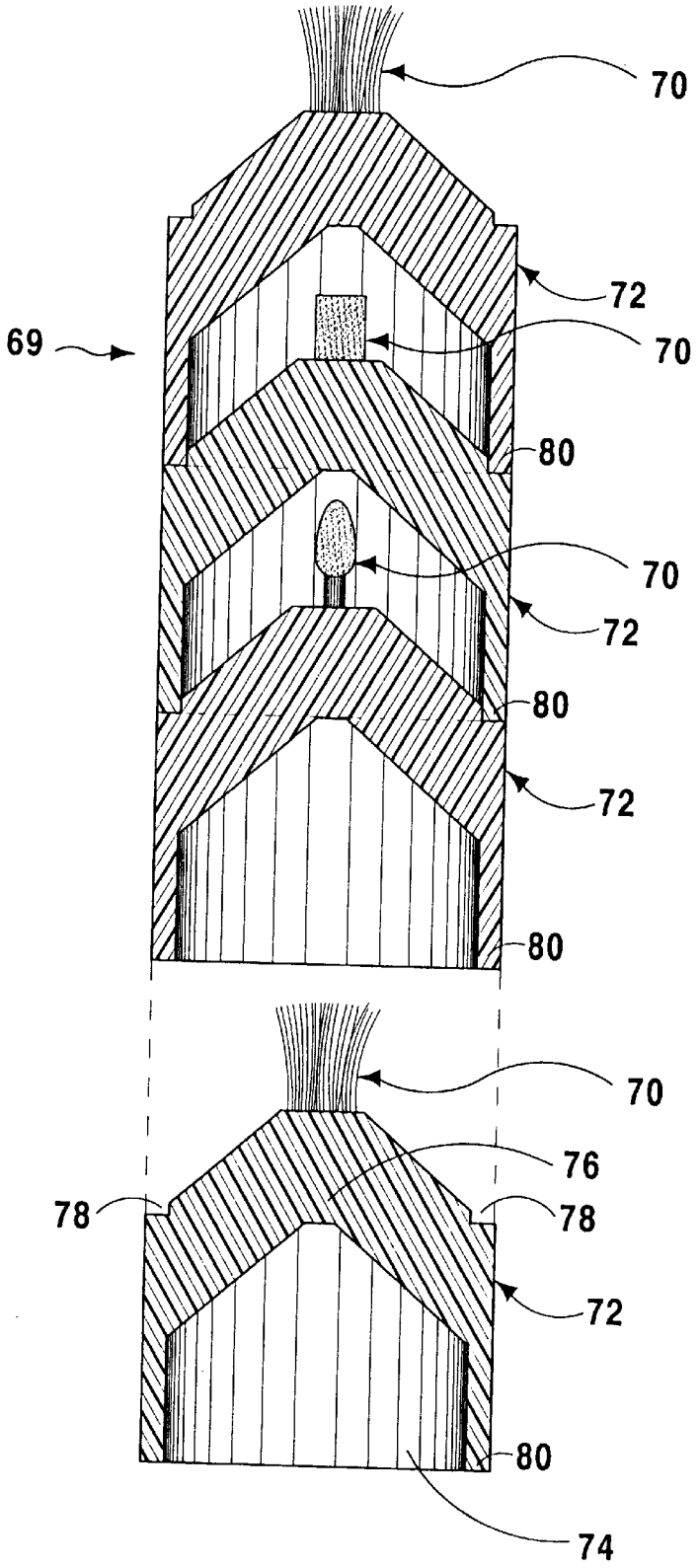
Figure 7:
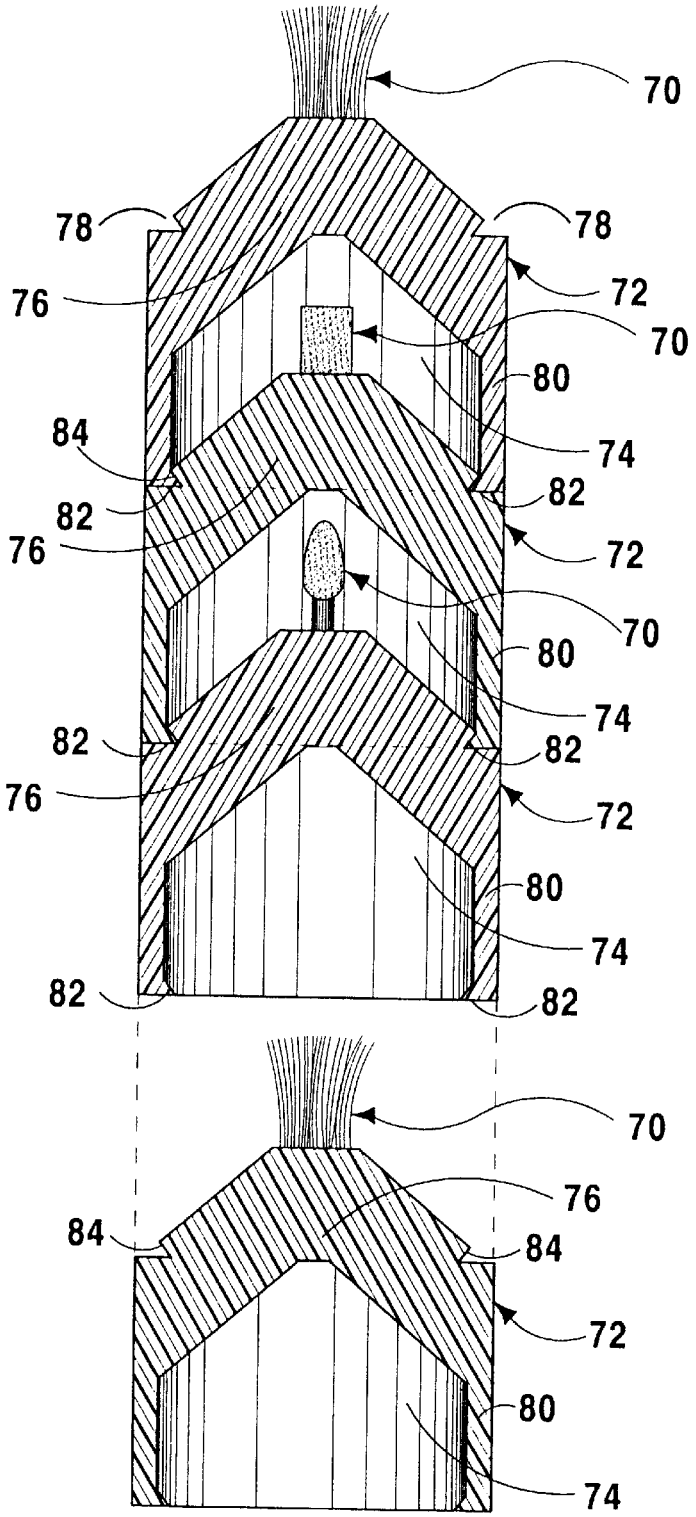

FIG. 6 is a cross-sectional view of a second embodiment of the multi-purpose cosmetic applicator of the present invention including an alternate means for connecting the plurality of sections together; and FIG. 7 is a cross-sectional view of the second embodiment of the multi-purpose cosmetic applicator of the present invention including an alternate device for releasably connecting the plurality of sections together.

DESCRIPTION OF THE REFERENCED NUMERALS

Turning now descriptively to the drawings, in which similar reference characters denote similar elements throughout the several views, the Figures illustrate the multi-purpose cosmetic applicator of the present invention. With regard to the reference numerals used, the following numbering is used throughout the various drawing figures.

10 multi-purpose cosmetic applicator of the present invention
12 housing of the multi-purpose cosmetic applicator of the present invention
14 plurality of sections forming housing
16 mid section of each section
18 toothed edges of each section
20 first end of housing
22 make up brush extending from first end of housing
24 second end of housing
26 lip stick tube extending from second end of housing
28 comb extending from a side of one of the plurality of sections
30 first end section
32 second end section
34 sponge type applicator
36 first sponge applicator
38 second sponge applicator
40 centrally located section
42 second applicator unit
44 sponge applicator extending from one end of second applicator unit
46 eyeliner extending from second end of second applicator unit
48 section of housing
50 third applicator unit
52 lip brush extending from one end of third applicator unit
54 blemish concealer extending from second end of third applicator unit
56 central section of applicator unit
60 first section of make-up brush
62 second section of make-up brush
64 third section of make-up brush
66 flat end section of applicator unit
68 base of first
69 second embodiment of multi-purpose cosmetic applicator
70 applicator unit of second embodiment of multi-purpose cosmetic applicator
72 sections forming second embodiment of multi-purpose cosmetic applicator
74 hollow base side of second embodiment of multi-purpose cosmetic applicator
76 top side of second embodiment of multi-purpose cosmetic applicator

78 rim extending around top side
80 defining side wall of hollow base side
82 protrusion extending from side wall of hollow base side
84 recess extending around rim

DETAILED DESCRIPTION OF THE PREFERRED EMBODIMENTS

Turning now descriptively to the drawings, in which similar reference characters denote similar elements throughout the several views, FIGS. 1 through 5*b* illustrate the multi-purpose cosmetic applicator of the present invention indicated generally by the numeral 10.

Figure 1:
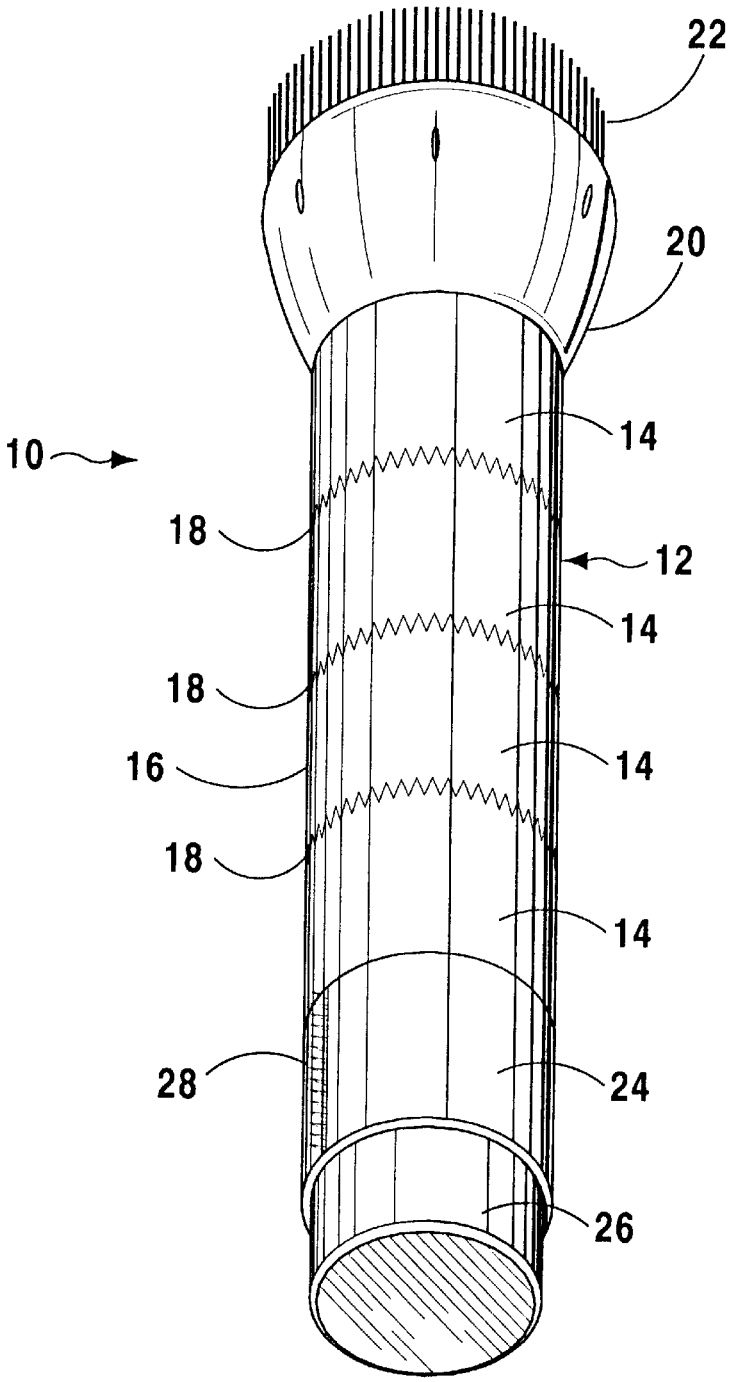
FIG. 1 is a top perspective view of the multi-purpose cosmetic applicator of the present invention.

The multi-purpose cosmetic applicator 10 is shown in its assembled form in FIG. 1 and includes a housing 12 formed of a plurality of individual releasably connected sections 14. Each of the plurality of sections 14 includes a hollow mid section 16 and a toothed edge 18 on either side of the mid section 16. The toothed edges 18 of adjacent sections 14 mate with each other to releasably connect the housing 12 together. Each section 14 is interchangeable and can connect with any other section 14 in any order desired by the user. Thus, the user may arrange the sections 14 as desired to provide the most useful and convenient arrangement of sections 14 based upon individual preference.

Extending from a first end 20 of the housing 12 is a make up brush 22. A lip stick holder 26 extends from a second end 24 of the housing 12. The lip stick holder 26 includes a retractable tube of lip stick therein. A comb 28 is positioned to extend from a side of one of the plurality of sections 14.

An exploded view of the multi-purpose cosmetic applicator 10 is illustrated in FIG. 2 showing the individual applicator units positioned within each of the plurality of sections 14. As can be seen from this figure, the multi-purpose cosmetic applicator 10 includes the plurality of sections 14 each being releasably connected together. Extending from a first end section 30 is the make-up brush 22. The make-up brush 22 is used to apply make-up such as blush to the face of a user. The make-up brush 22 is releasably connected to the first end section 30 and may be either replaced when the brush 22 is worn out or removed and replaced by an alternate cosmetic applicator if desired.

Extending from a second end section 32 of the housing 12 is the lip stick holder 26. The lip stick holder 26 is used to hold a stick of lip stick for application to the lips of a user. The lip stick is retractably positioned within the holder 26 and upon turning the holder 26 will either extend from or retract into the holder 26. This is similar to conventional lip stick holders. The lip stick holder 26 is also releasably connected to the second end section 32 and may be either replaced when the holder 26 is empty, replaced by another holder 26 containing a more desirable shade of lip stick or removed and replaced by another more desirable cosmetic applicator.

Releasably positioned within and partially extending from the first end section 30 is a sponge type applicator unit 34. The sponge type applicator unit 34 includes a first sponge applicator 36 extending into the mid section 16 of the first end section 30 and a second sponge applicator 38 extending from an opposing side of the sponge type applicator unit 34. The second sponge applicator 38 extends from the first end section 30 for use as desired. The sponge type applicator unit 34 is removably positioned within its respective section 14. This allows the user the option of turning the applicator around so that the first sponge applicator 36 extends from the mid section 16 and the second sponge applicator 38 extends into the mid section 16 or to replace the sponge type applicator unit 34 with another applicator.

A centrally located section 40 is illustrated with a second applicator unit 42 releasably connected therein. The second applicator unit 42 includes a sponge type applicator 44 extending from one end thereof and an eyeliner 46 extending from an opposing end thereof. In the figure, the eyeliner 46 is illustrated as extending from the centrally located section 40 and the sponge type applicator 44 is illustrated as extending into the mid section 16 of the centrally located section 40. The second applicator unit 42 may also be removed from its position and turned so that the eyeliner 46 extends into the mid section 16 of the centrally located section 40 and the sponge type applicator 44 extends from the centrally located section 40. Alternatively, the second applicator unit 40 may be replaced with an alternative applicator unit. A section 48 without an applicator unit connected therein is illustrated as connected between the centrally located section 40 and the second end section 32. This section 48 provides an area for the eyeliner 46 to extend into when the sections 14 are connected together to form the housing 12.

A third applicator unit 50 is illustrated as being releasably connected to the second end section 32. The third applicator unit 50 includes a lip brush 52 extending from one end thereof and blemish concealer 54 extending from an opposing end thereof. In the figure, the blemish concealer 54 is illustrated as extending from the second end section 32 and the lip brush 52 is illustrated as extending into the mid section 16 of the second end section 32. The third applicator unit 50 may also be removed from its position and turned so that the blemish concealer 54 extends into the mid section 16 of the second end section 32 and the lip brush 52 extends from the second end section 32. Alternatively, the third applicator unit 50 may be replaced with an alternative applicator unit. Also positioned on and secured to an outer side of the second end section 32 is a comb 28. The comb 28 is illustrated as being connected to extend from a side of the second end section 32. However, the comb may extend from any of the sections 14 of the housing 12, connection of the comb 28 so as to extend from the second end section 32 is for purposes of example only and not meant to limit the invention in any manner.

Each applicator unit includes a mid section 56 having a circumference substantially equal to an inner circumference of each of the plurality of housing sections 14. Thus, when the applicator unit is positioned to partially extend into its respective section, it forms a pressure fit therewith. When a subsequent section 14 is positioned to cover the portion of the applicator unit extending from the section 14, the subsequent section 14 also forms a pressure seal with the mid section 56 of the applicator unit whereby the teeth 18 on the edge of each section 14 mate and the two adjacent sections 14 are releasably secured together. To release the connection between adjacent sections 14 a force must be applied in a direction away from the mating teeth 18 thereby pulling the sections 14 apart. The applied force must overcome the force formed by the pressure seal between the applicator unit and the two sections 14.

The applicator units illustrated are for purposes of description only and not meant to limit the invention in any manner. Each applicator unit may be designed to include any pair of applicators desired and not only the combinations illustrated and described herein. While preferred combinations for the applicator units are shown and described herein, those of ordinary skill in the art who have read the description will appreciate that there are numerous other combinations for the applicator units and, therefore, as used herein the phrase "applicator means for use in applying cosmetics"

should be construed as including all such combinations as long as they achieve the desired result of providing means for applying make-up and cosmetics on a user, and, therefore, that all such equivalent mechanisms and combinations are to be considered as equivalents to the ones described herein.

FIGS. 3, 3*a* and 3*b* illustrate a top view of the make-up brush 22, each figure showing a view with a different section of the brush retracted. As can be seen from these figures, the make-up brush 22 includes a first section 60, a second section 62 and a third section 64. Each of the first, second and third sections 60, 62 and 64, respectively, are individually retractable by the user to set the width of the make-up brush 22 to a desired width.

FIG. 3 illustrates the make-up brush 22 with the first, second and third sections 60, 62 and 64, respectively, in an extended position. In this arrangement, the width of the brush 22 is at its greatest size and will apply the make-up to a maximum possible area.

FIG. 3*a* illustrates the make-up brush 22 with the first section 60 in a retracted position and the second and third sections 62 and 64, respectively, in an extended position. In this arrangement, the width of the brush 22 is at a median size and will apply the make-up to a desired area between its maximum and minimum areas possible.

FIG. 3*b* illustrates the make-up brush 22 with the first and second sections 60 and 62, respectively, retracted and the third section 64 in an extended position. In this arrangement, the width of the brush 22 is at its smallest size and will apply the make-up to a minimum area possible with the brush 22.

A side view of the make-up brush 22 of the first end section 30 and extending from the first end 20 of the multi-purpose cosmetic applicator 10 is illustrated in FIG. 5. This figure illustrates the first, second and third sections 60, 62 and 64, respectively, in an extended position. When any combination of the first, second and third sections 60, 62 and 64, respectively, are retracted, they are drawn into and held within a base section 68 of the make-up brush 22. This figure illustrates the make-up brush 22 including a maximum width for the application of make-up and/or cosmetics to the face of the user.

A side view of the make-up brush 22 of the first end section 30 and extending from the first end 20 of the multi-purpose cosmetic applicator 10 is shown in FIG. 5*a* illustrating the first section 60 in a retracted position and the second and third sections 62 and 64, respectively, in an extended position. When the first section 60 is retracted, it is drawn into and held within the base section 68 of the make-up brush 22. This figure illustrates the make-up brush 22 including a median width for the application of make-up and/or cosmetics to the face of the user.

A side view of the make-up brush 22 of the first end section 30 and extending from the first end 20 of the multi-purpose cosmetic applicator 10 is shown in FIG. 5*a* illustrating the first and second sections 60 and 62, respectively, in a retracted position and the third section 64 in an extended position. When the first and second sections 60 and 62, respectively, are retracted, they are drawn into and held within the base section 68 of the make-up brush 22. This figure illustrates the make-up brush 22 including a minimum width for the application of make-up and/or cosmetics to the face of the user.

FIG. 4 illustrates a front view of the sponge type applicator unit 34 taken in the direction of the arrows labeled 4—4 of FIG. 2. From this view the sponge applicator 38 is seen extending from the central section 56 of the sponge type applicator unit 34. The central section 56 is illustrated as being round and including a flat end section 64. The sponge applicator 38 extends from the flat end section 64 of the sponge type applicator unit 34 for receiving the desired cosmetics thereon for application to the face of the user.

FIG. 6 illustrates a second embodiment of the multi-purpose cosmetic applicator indicated generally by the numeral 69 in which applicator units 70 are integrally formed with and extending from a respective housing section 72. Each section 72 includes a hollow base side 74 and a top side 76, a respective applicator unit 70 extending from the top side 76 of each section 72. The top side 76 includes a rim 78 extending therearound. The rim 78 is of a circumference substantially equal to a circumference of the hollow base side 74. When the sections 72 are releasably connected together, the hollow base side 74 of a first one of the sections 72 receives an applicator unit 76 of an adjacent one of said sections 72 positioned therebelow. The rim 78 of the adjacent section receives a defining side wall 80 of the hollow base side 74 positioned thereabove forming a pressure seal therebetween as is clearly illustrated in FIG. 6. Adjacent ones of the sections 72 are thus releasably connected together to form the multi-purpose cosmetic applicator 69. As many applicator units 70 as desired may be releasably connected to form the single applicator 69 of the present invention.

FIG. 7 illustrates an alternate embodiment for releasably connecting adjacent sections 72 for the second embodiment of the multi-purpose applicator 69. In this embodiment, a protrusion 82 extends around the side wall 80 defining the hollow base side 74 and a recess 84 extends around the rim 78 on the top side 76 of the section 72. When adjacent sections 72 are releasably connected, the applicator unit 70 is positioned within the hollow base side 74 of a section 72 positioned thereabove and the recess 84 extending around the rim 78 receives the protrusion 82 extending from the side wall 80 of the section 72 positioned thereabove to form a secure selectively releasable connection therebetween.

The operation of the multi-purpose cosmetic applicator 10 will now be described with reference to the figures. In operation, the multi-purpose cosmetic applicator 10 is formed by releasably securing a desired applicator unit within a respective one of the plurality of sections. A pressure is applied to the applicator unit towards the respective section until a pressure seal is formed therebetween. In this position one applicator extending from a side of the applicator unit extends into the mid section of the housing section and a second applicator of the applicator unit extends from a first end of the housing section and may be easily used to apply make-up and/or cosmetics to a user as desired. Each desired applicator unit is releasably secured with a respective section in this manner.

In order to form the multi-purpose cosmetic applicator the plurality of applicator unit-section combinations must now be releasably connected together. To do this the user will pick two sections which are desired to be connected together. These applicator unit-section combinations are aligned so that the applicator unit extending from a first one of the sections will be received by the second section at an end opposite that which its respective applicator unit extends. Thus, the applicator unit of the first section will be received within the mid section of the second section. A force is then applied to each section towards the other until a pressure fit is formed between the second section and the applicator unit of the first section. The first and second sections are then turned to align and mate the teeth extending from each section. This is repeated until each desired applicator unit-section combination is connected to form a single unit. The lip stick holder may be releasably connected to one end in the same manner and the make-up brush may be connected to the opposing end if desired. The comb may be attached to extend from any one of the sections as desired.

In order to use any of the applicator units, the sections are separated at the section connected to the desired applicator unit so that the desired applicator extends from its respective section. The sections are separated by applying a force in a direction opposite the connection force. The applicator is then used to apply make-up and/or cosmetics and the sections may be reconnected in the manner described above.

If the embodiment of FIGS. 6 and 7 is used, the sections are aligned such that the applicator units will be received within the hollow base side of an adjacent section. Upon alignment, a force is applied causing the side wall of the base side to be received and releasably connected to a rim on an adjacent section therebelow. This causes the applicator unit of the section therebelow to be received within the hollow base side. This is repeated to connect the desired sections together in a manner similar to that described above with respect to the first embodiment. If the connection device of FIG. 7 is used, the force is applied until the protrusion extending into the hollow base side is received by the recess extending around the rim. The sections of this embodiment are separated by applying a force in a direction opposite the force applied to connect the sections. The applicator unit exposed by separating the sections may now be used. After use, the sections may be reconnected in the manner described above.

From the above description it can be seen that the multi-purpose cosmetic applicator of the present invention is able to overcome the shortcomings of prior art devices by providing a multi-purpose cosmetic applicator which is able to retain a plurality of cosmetic applicators in a single unit. The multi-purpose cosmetic applicator allows a user to apply numerous types of make-up such as eyeliner, blush, blemish consealers, lipstick, etc. with a single device by including an eyebrow brush, eyeliner, sponge, comb, lipstick holder and make-up brush removably contained within a housing and a make-up brush extending from the housing including three individually retractable sections allowing the user to adjust the width of the brush. The housing of the multi-purpose cosmetic applicator is divided into releasably connected sections and the individual applicators are each contained within a respective section of the housing whereby releasing a desired section from its connection to an adjacent section of the housing exposes the applicator contained therein. Furthermore, the multi-purpose cosmetic applicator of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A multi-purpose cosmetic applicator for aiding a person in applying numerous types of cosmetics and eliminating the need to carry an individual applicator for each type of cosmetic, said multi-purpose cosmetic applicator comprising:

a) a plurality of hollow sections, each of said plurality of hollow sections having a circumference and including a first end, a second end and a midsection connecting said first and second ends; and b) a plurality of applicator units, each of said plurality of applicator units having a circumference substantially equal to the circumference of said plurality of hollow sections and including a central section, a first applicator device extending from a first side of said central section and a second applicator device extending from a second side of said central section, wherein a pressure seal is formed between one of said first and second ends of each of said plurality of hollow sections and a respective one of said applicator units such that one of said first and second applicator devices extends into said midsection of said respective hollow section and the other of said first and second applicator devices extends from said one of said first and second ends to form a plurality of section/applicator device combinations and each of said plurality of section/applicator device combinations form a pressure seal at the other of said first and second ends with the one of said first and second ends of an adjacent section/applicator device combination.

2. The multi-purpose cosmetic applicator as recited in claim 1, wherein said first and second ends each include teeth extending therearound, said teeth on said first end mating with said teeth on said second end of said adjacent section/applicator device combination.

3. The multi-purpose cosmetic applicator as recited in claim 1, further comprising a lip stick holder releasably connected to an end one of said section/applicator device combinations.

4. The multi-purpose cosmetic applicator as recited in claim 3, further comprising a make-up brush releasably connected to an opposing end one of said section/applicator device combinations.

5. The multi-purpose cosmetic applicator as recited in claim 1, further comprising a make-up brush releasably connected to an end one of said section/applicator device combinations.

6. The multi-purpose cosmetic applicator as recited in claim 1, wherein said make-up brush has an adjustable width and includes first, second and third retractable sections, allowing said width to be adjusted.

7. The multi-purpose cosmetic applicator as recited in claim 1, further comprising a comb connected to and extending from one of said plurality of hollow sections.

8. The multi-purpose cosmetic applicator as recited in claim 1, wherein said first applicator device is a sponge applicator having a predetermined thickness.

9. The multi-purpose cosmetic applicator as recited in claim 8, wherein said second applicator device is a sponge applicator having a thickness greater than said predetermined thickness.

10. The multi-purpose cosmetic applicator as recited in claim 1, wherein said first applicator device is an eyeliner and said second applicator device is a sponge applicator.

11. The multi-purpose cosmetic applicator as recited in claim 1, wherein said first applicator device is a blemish concealer and said second applicator device is a lip brush.

12. The multi-purpose cosmetic applicator for aiding a person in applying numerous types of cosmetics and eliminating the need to carry an individual applicator for each type of cosmetic, said multi-purpose cosmetic applicator comprising:

a) a plurality of releasably interconnecting sections, each of said plurality of releasably interconnecting sections including a top side and a skirt extending therefrom to form a pool, said skirt having a circumference, said top side including a rim extending therearound on a side opposite said skirt, said rim having a circumference substantially equal to said circumference of said skirt; and b) a plurality of applicator units, each of said plurality of applicator units connected to and extending from said top side of a respective one of said plurality of releasably interconnecting sections, wherein a pressure seal is formed between said rim and said skirt of adjacent ones of said releasably interconnecting sections whereby said applicator device extending from each top side extends into said pool of said adjacent releasably interconnecting sections.

13. The multi-purpose cosmetic applicator as recited in claim 12, wherein each of said skirts includes a protrusion extending around an inner side thereof and each of said rims further includes a recess extending therearound for receiving said protrusion therein when forming said pressure seals between adjacent ones of said releasably interconnecting sections.

14. The multi-purpose cosmetic applicator as recited in claim 12, wherein each of said plurality of applicator devices is one of a sponge applicator, a lip brush, an eyeliner and a blemish concealer.

15. The multi-purpose cosmetic applicator as recited in claim 12, further comprising a comb connected to and extending from one of said plurality of releasably interconnecting sections.

16. The multi-purpose cosmetic applicator as recited in claim 12, further comprising a make-up brush releasably connected to an end one of said releasably interconnecting sections.

17. The multi-purpose cosmetic applicator as recited in claim 12, further comprising a lip stick holder releasably connected to an end one of said releasably interconnecting sections.

18. The multi-purpose cosmetic applicator as recited in claim 16, further comprising a lip stick holder extending from an opposing end one of said releasably interconnecting sections.

19. The multi-purpose cosmetic applicator as recited in claim 12, wherein said make-up brush has an adjustable width and includes first, second and third retractable sections, allowing said width to be adjusted.

* * * * *